United States Patent [19]

Nelson

[11] 4,438,607

[45] Mar. 27, 1984

[54] METHOD AND APPARATUS FOR LEVELING A STORAGE STRUCTURE

[75] Inventor: Delmer R. Nelson, Cordova, Ill.

[73] Assignee: A. O. Smith Harvestore Products, Inc., Arlington Heights, Ill.

[21] Appl. No.: 362,919

[22] Filed: Mar. 29, 1982

[51] Int. Cl.[3] ..... E02D 27/00

[52] U.S. Cl. ..... 52/126.1; 52/247; 52/274; 52/295

[58] Field of Search ..... 52/295, 245, 246, 247, 52/126.1, 126.7, 294, 698, 293, 274; 249/219 R, 219 W, 83, 158, 159, 155, 167

[56] References Cited

U.S. PATENT DOCUMENTS

| | | | |
|---|---|---|---|
| 1,644,586 | 10/1927 | Heltzel | 249/159 |
| 2,045,478 | 6/1936 | Kuehn | 52/295 |
| 2,361,272 | 10/1944 | Covey | 52/293 |
| 2,540,622 | 2/1951 | Langenberg | 52/293 |
| 3,927,497 | 12/1975 | Yoshinaga | 52/247 X |
| 4,218,859 | 8/1980 | Sams | 52/295 X |

FOREIGN PATENT DOCUMENTS

| | | | |
|---|---|---|---|
| 2283268 | 3/1976 | France | 52/295 |

*Primary Examiner*—John E. Murtagh
*Assistant Examiner*—Kathryn Ford
*Attorney, Agent, or Firm*—Andrus, Sceales, Starke & Sawall

[57] ABSTRACT

A method and apparatus for leveling a storage structure. A plurality of pairs of anchor bolts project upwardly from the footing of the structure and each pair is positioned in radially spaced relation. A support bar is connected to the threaded upper ends of each respective pair of bolts, and through threaded adjustment, the bars can be leveled in a radial direction, as well as leveled so that all of the bars lie in the same horizontal plane. Foundation angles are bolted to the support bars and carry a series of foundation sheets which comprise the lowermost tier of the storage structure. The bolts connecting the foundation angles to the support bars extend through slots in the lower flange of the angle, as well as slots in the bar to provide an adjustment for the foundation angle in a circumferential, as well as radial direction. By proper adjustment of the bolted connections, the foundation sheets can be properly leveled to insure the plumb condition of the storage structure.

5 Claims, 2 Drawing Figures

METHOD AND APPARATUS FOR LEVELING A STORAGE STRUCTURE

BACKGROUND OF THE INVENTION

Certain large storage structures, such as those employed for storing manure slurry, or structures employed to store grain or silage, are composed of a series of glass coated metal plate sections or sheets, which are bolted together to form the cylindrical storage structure. The storage structure is supported on a concrete footing or foundation and it is important that the lowermost tier of sheets be properly leveled on the foundation in order to insure that the storage structure will be plumb. If the structure is not plumb, the weight of the stored material can cause undue stress in the walls of the structure which can result in premature failure.

In the past, the system employed for leveling the foundation sheets of the storage structure has been time consuming and expensive. In the conventional system, anchor bolts were embedded in the footing and L-shaped clamping members were mounted on the upper projecting ends of the anchor bolts. The upper horizontal flanges of the clamping members were adapted to engage the lower flange of a foundation angle which was attached to the lower edge of the foundation sheets. To level the foundation sheets, shims were placed beneath the foundation angle to provide a vertical adjustment, and the foundation angles were moved radially on the shims to provide radial positioning. After proper adjustment, the clamps were then connected onto the anchor bolts to hold the foundation angle and foundation sheet in the leveled position. If during the leveling procedure it was found that a foundation sheet was not level, the clamping members would be released for readjustment of the level. Release of the clamping members would render the foundation sheet adjustable in all directions, so that both radial, circumferential and height adjustments would have to be re-established.

SUMMARY OF THE INVENTION

The invention is directed to an improved method and apparatus for leveling a large storage structure fabricated from a plurality of interconnected metal plate sections or sheets.

In accordance with the invention, a plurality of pairs of anchor bolts are embedded in the footing for the structure and the upper threaded ends of the bolts project outwardly from the footing. A support bar is mounted on each radially aligned pair of the anchor bolts, and through threaded adjustment, each bar is leveled in a radial direction, as well as leveling the support bars so that they all lie in the same horizontal plane.

Foundation angles, which carry the lowermost or foundation sheets of the structure, are bolted to the support bars and the bolts extend through aligned slots in the lower flange of the foundation angle, as well as slots in the support bars. With this slotted connection, the foundation angles, and the foundation sheets carried by the foundation angles, can be adjusted circumferentially of the structure, as well as radially to provide accurate interconnection of the foundation sheets.

The method of the invention substantially reduces the labor cost involved in leveling the foundation sheets of large storage structures and provides a more precisely plumb structure which eliminates any possibilities of any undue stress in the walls of the structure caused by an out-of-plumb condition.

Other objects and advantages will appear in the course of the following description.

DESCRIPTION OF THE DRAWINGS

The drawings illustrate the best mode presently contemplated of carrying out the invention.

In the drawings

DESCRIPTION OF THE ILLUSTRATED EMBODIMENT

Figure 1:
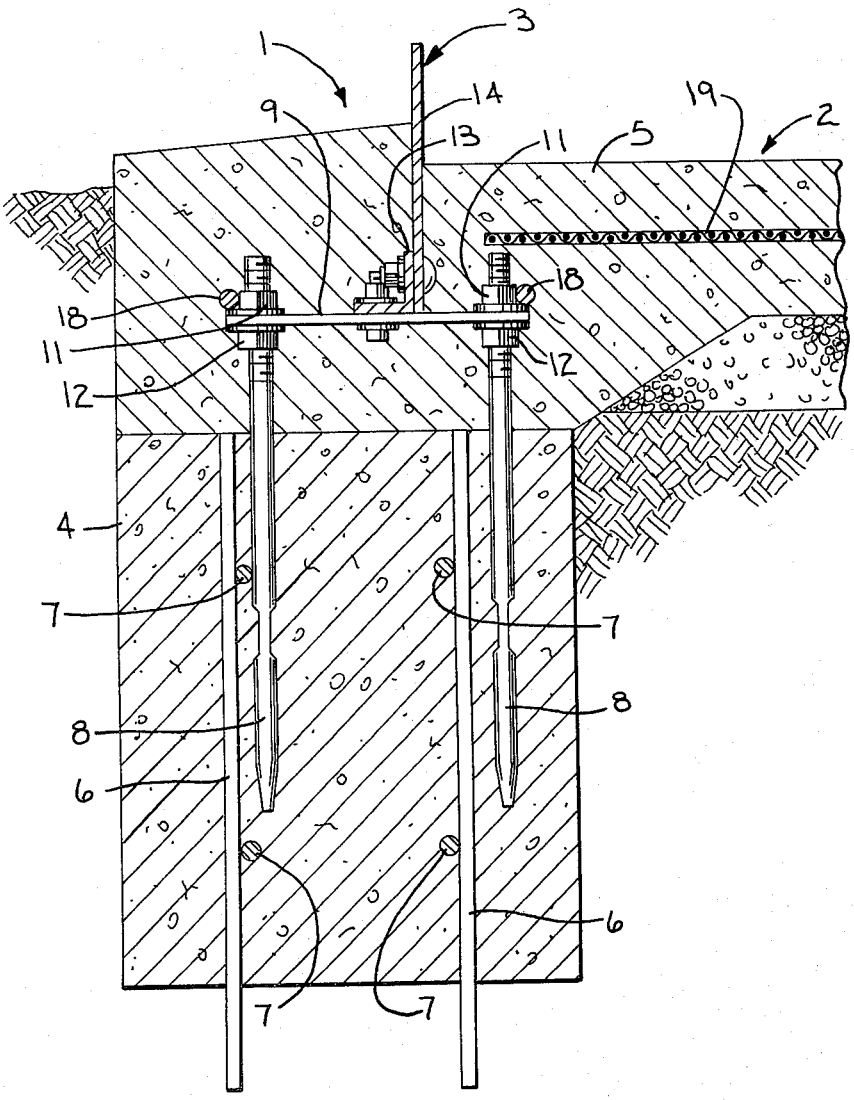
FIG. 1 is a vertical section of the foundation of a storage structure incorporating the leveling apparatus of the invention.

FIG. 1 illustrates the lower portion of a storage structure 1 composed of a concrete foundation 2 which supports a generally cylindrical shell 3. The shell can be formed of a plurality of steel plate sections of panels which are bolted together to form the cylindrical configuration. To protect the steel plate sections from corrosion, both inner and outer surfaces of the plate sections can be coated with a corrosion resistant material, such as glass or plastic.

The foundation 2 includes a generally circular footing 4 and the periphery of a concrete slab 5 is supported on the footings. The footing 4 can be reinforced by a series of vertical leveling rods 6 which carry horizontal reinforcement 7.

In accordance with the invention, a plurality of pairs of anchor bolts 8 are embedded in the footing 4, and the upper ends of the anchor bolts project from the footing and are threaded. Mounted on each pair of radially spaced anchor bolts 8 is a support bar 9 and the ends of the support bars are provided with elongated openings 10 which receive the threaded upper ends of the anchor bolts 8. The support bar can be leveled in a radial direction, as well as leveled so that all support bars lie in the same horizontal plane by means of nuts 11 and 12 which are threaded on the upper ends of the anchor bolts and are located on opposite sides of the support bar.

Figure 2:
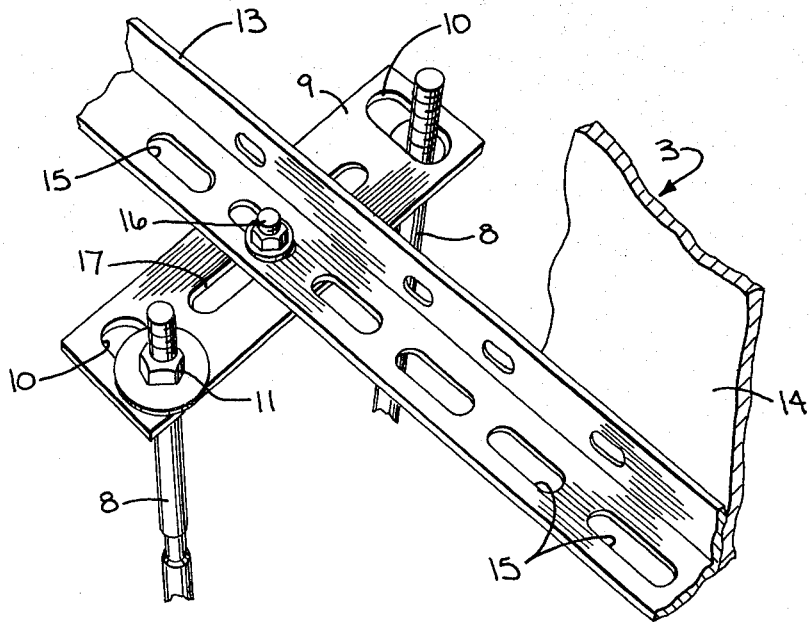
FIG. 2 is a perspective view of the foundation angle as supported on the support bars.

Curved foundation angles 13 are supported on the support bars 9 and the foundation sheets 14 of shell 3 are bolted to the vertical flanges of the foundation angles. As best shown in FIG. 2, the horizontal flange of each foundation angle 13 is provided with a series of slots 15 which receive bolts 16 and the bolts 16 also extend through radially extending slots 17 in the support bars. The slots 15 in the foundation angles 13 permit the foundation angle to be adjusted in a circumferential direction, while the slots 17 in the support bars 9 permit radial adjustment of the foundation angle 13 and foundation sheets 14. Through these two adjustments, the overlapping edges of the foundation sheets 14 can be properly aligned and bolted together.

In use of the apparatus of the invention, the leveling rods 6 are located within the excavation for the footing and reinforcing rods 7 are attached between adjacent leveling rods. The footing 4 is then poured with the upper ends of the leveling rods serving as a strike-off for the footing.

After pouring of the footing, the pre-assembled units, each consisting of a pair of anchor bolts 8, a support bar 9 and the nuts 11 and 12 are installed by pushing the lower ends of the anchor bolts down into the wet concrete until the upper ends of the anchor bolts are at the desired approximate level. After the concrete is set, the support bars 9 are adjusted by threading nuts 11 and 12 so that the support bars are level in a radial direction, as well as the support bars all lying in the same horizontal plane.

With the support bars properly leveled, the foundation angles 13 carrying the foundation sheets 4 are then mounted on the support bars and bolted to the bars with the angles 13 being shifted both circumferentially and radially to obtain the proper adjustment for bolting together of the foundation sheets 14. With the tier of foundation sheets properly plumbed, reinforcing rods 18 can be positioned across the ends of the support bars 9 and reinforcing mesh 19 is installed over the central portion of the foundation in preparation for pouring slab 5. Slab 5 is then poured to complete the assembly of the foundation of the storage structure. Subsequently additional tiers of sheets can be attached to the upper edge of the foundation sheets 14 to complete the cylindrical shell 3.

Various modes of carrying out the invention are contemplated as being within the scope of the following claims particularly pointing out and distinctly claiming the subject matter which is regarded as the invention.

I claim:

1. In a storage structure, a foundation, a plurality of pairs of anchor elements embedded in the foundation in circumferentially spaced relation, the upper ends of said anchor elements projecting above said foundation, a support member connected to the upper ends of each pair of anchor members, means for adjusting the height of each of the support members with respect to the corresponding anchor elements to thereby enable the support member to be leveled, a plurality of generally curved wall sections mounted on the support members and arranged in circular configuration, each section having a generally horizontal member supported on said support members, one of said members having a plurality of first elongated slots and the other of said members having a plurality of second elongated slots disposed at an angle to said first slots, and a plurality of connectors extending through aligned first and second slots to connect the sections to the support members, said first and second slots permitting both radial and circumferential adjustment of said sections relative to said support members.

2. The structure of claim 1, wherein said first slots extend generally radially and said second slots extend generally circumferentially.

3. The structure of claim 1, wherin the upper end of each anchor element is threaded and extends through an opening in the respective support member, and said means for adjusting the level of said support members includes a pair of nuts threaded on the upper end of each anchor element, the nuts of each pair being located on opposite sides of said support member.

4. The structure of claim 3, in which said openings are elongated in a circumferential direction.

5. In a storage structure, a foundation, a plurality of pairs of anchor rods embedded in the foundation in circumferentially spaced relation, the anchor rods of each pair being disposed generally radially and the upper ends of said anchor rods projecting above said foundation, a support member connected to the upper ends of each pair of anchor rods, means for adjusting the height of each of the support members with respect to the corresponding anchor rods to thereby enable the support member to be leveled, a plurality of generally curved wall sections having generally horizontal flanges supported on the support members, said flanges having a plurality of elongated circumferential extending slots, each support member having an elongated radially extending slot, and a plurality of connectors extending through aligned radial and circumferential slots to connect the horizontal flanges to the support members.

* * * * *

UNITED STATES PATENT AND TRADEMARK OFFICE

CERTIFICATE OF CORRECTION

PATENT NO. : 4,438,607

DATED : March 27, 1984

INVENTOR(S) : DELMER R. NELSON

It is certified that error appears in the above-identified patent and that said Letters Patent is hereby corrected as shown below:

Col. 4, Line 12, CLAIM 3, Cancel "wherin" and substitute therefor ---wherein---; Col. 4, line 15, CLAIM 3, Cancel "level" and substitute therefor ---height---.

Signed and Sealed this

*Thirtieth* Day of *October 1984*

[SEAL]

*Attest:*

GERALD J. MOSSINGHOFF

*Attesting Officer*

*Commissioner of Patents and Trademarks*